US009633665B2

(12) United States Patent
Hennequin

(10) Patent No.: US 9,633,665 B2
(45) Date of Patent: Apr. 25, 2017

(54) PROCESS AND ASSOCIATED SYSTEM FOR SEPARATING A SPECIFIED COMPONENT AND AN AUDIO BACKGROUND COMPONENT FROM AN AUDIO MIXTURE SIGNAL

(71) Applicant: Audionamix, Paris (FR)

(72) Inventor: Romain Hennequin, Paris (FR)

(73) Assignee: AUDIONMIX, Paris (FR)

( * ) Notice: Subject to any disclaimer, the term of this patent is extended or adjusted under 35 U.S.C. 154(b) by 195 days.

(21) Appl. No.: 14/555,230

(22) Filed: Nov. 26, 2014

(65) Prior Publication Data

US 2015/0149183 A1 May 28, 2015

(30) Foreign Application Priority Data

Nov. 28, 2013 (FR) ..... 13 61792

(51) Int. Cl.
*G10L 21/00* (2013.01)
*G10L 19/26* (2013.01)
*G10L 21/028* (2013.01)

(52) U.S. Cl.
CPC ..... *G10L 19/26* (2013.01); *G10L 21/028* (2013.01)

(58) Field of Classification Search
None
See application file for complete search history.

(56) References Cited

U.S. PATENT DOCUMENTS 6,691,082 B1 * 2/2004 Aguilar ..... G10L 19/0208 704/219
8,812,322 B2 * 8/2014 Mysore ..... G10L 21/028 704/256.2

(Continued)

OTHER PUBLICATIONS

Virtanen, Tuomas, "*Monaural Sound Source Separation by Non-negative Matrix Factorization with Temporal Continuity and Sparseness Criteria*", *IEEE Transactions on Audio, Speech and Language Processing*, vol. 15., No. 3, Mar. 2007 (pp. 1066-1074).

(Continued)

*Primary Examiner* — Satwant Singh
(74) *Attorney, Agent, or Firm* — Leydig, Voit & Mayer Ltd.

(57) ABSTRACT

Processes are described herein for transforming an audio mixture signal data structure into a specified component data structure and a background component data structure. In the processes described herein, pitch differences between a guide signal and a dialogue component of an audio mixture signal are accounted for by explicit modeling. Processes described herein can involve obtaining an audio guide signal data structure that corresponds to a dubbing of the specified component, determining parametric spectrogram model data structures for spectrograms of the specified component and the background component, estimating parameters of the parametric spectrogram model data structures to produce data structures representing, a temporary specified signal and a temporary background signal, and filtering the audio mixture signal data structure using the data structures representing the temporary specified signal and the temporary background signal in order to produce data structures representing a specified audio signal and an audio background signal.

19 Claims, 4 Drawing Sheets

(56) References Cited

U.S. PATENT DOCUMENTS

| | | | | |
|---|---|---|---|---|
| 9,460,729 | B2 * | 10/2016 | Dickins | G10L 19/008 |
| 9,495,970 | B2 * | 11/2016 | Dickins | G10L 19/008 |
| 2006/0100867 | A1 * | 5/2006 | Lee | G10L 21/0208 704/226 |
| 2015/0248889 | A1 * | 9/2015 | Dickins | G10L 19/008 704/500 |
| 2015/0356978 | A1 * | 12/2015 | Dickins | G10L 19/008 704/226 |
| 2016/0189731 | A1 * | 6/2016 | Hennequin | G10L 19/02 381/66 |
| 2016/0307554 | A1 * | 10/2016 | Tsai | G10K 11/175 |

OTHER PUBLICATIONS

Smaragdis, Paris, et al., "*Separation by "Humming": User-Guided Sound Extraction from Monophonic Mixtures", IEEE Workshop on Applications of Signal Processing to Audio and Acoustics*, New Paltz, NY, Oct. 2009 (4 pages).

LeMagoarou, L, et al., "*Text-informed Audio Source Separation Using Nonnegative Matrix Partial Co-Factorization", 2013 IEEE International Workshop on Machine Learning for Signal Processing*, Southampton, UK, Sep. 2013, (7 pages).

Fevotte, C., et al., "*Nonnegative Matrix Factorization with Itakura-Saito Divergence, with Application to Music Analysis", Neural Computation*, 21, 2008 Massachusetts Institute of Technology, (pp. 793-830).

Durrieu, Jean-Louis, et al., "*An Interative Approach to Monaural Musical Mixture De-Soling", International Conference on Acoustics, Speech, and Signal Processing* (*ICASSP*), Taipei, Taiwan, Apr. 2009, (pp. 105-108).

* cited by examiner

PROCESS AND ASSOCIATED SYSTEM FOR SEPARATING A SPECIFIED COMPONENT AND AN AUDIO BACKGROUND COMPONENT FROM AN AUDIO MIXTURE SIGNAL

FIELD OF THE INVENTION

The present invention relates to the field of processes and systems for separation of a specific contribution from a background component of an audio mixture signal.

BACKGROUND

A soundtrack of a movie or a TV show consists of dialogue superimposed with special audio effects and/or music. For an old movie, the soundtrack is a mixture of at least two of these components. Thus, if one wishes to broadcast the movie in a version other than the original one, one may need to separate the dialogue component from the background component in the original soundtrack. Doing so makes it possible to add, onto an isolated background component, a dubbed dialogue in a different language in order to produce a new soundtrack.

In some situations, the producers of a movie may only have a license to broadcast a piece of music in a particular country or region or for a limited duration of time. It may be illegal to broadcast a movie for which the soundtrack does not conform to the contract terms. To broadcast the movie, it may then be necessary to separate the dialogue component of the soundtrack from the background component of the soundtrack in order to use the isolated original dialogue to a new piece of music in order to get a new soundtrack.

In the general field of audio signal processing, source separation has been an important topic during the past decade. In the prior art, audio source separation was first addressed in a blind context. Non-negative matrix factorization (NMF) has been widely used in this context. For instance, the document by T. Virtanen, "Monaural Sound Source Separation by Nonnegative Matrix Factorization with Temporal Continuity and Sparseness Criteria," IEEE Transactions on Audio, Speech and Language Processing, vol. 15, no. 3, pp. 1066-1074, March 2007, divulges an NMF for source separation. However, one of the main drawbacks of this technique is the difficulty to cluster the factorized elements and associate them with a particular source.

More recently, numerous works have proposed adding extra information to NMF methods to improve results. In the particular field of musical source separation (i.e. separation of an instrument from a band or orchestra), an algorithm was proposed in which the different spectral shapes of each source are learned on isolated sounds and then used to decompose the mixture. In another work, a MIDI file is used to guide the separation of instruments in music pieces.

In the particular field of separating speech from background noise, one proposal has been to use a guide sound signal and to mimick the dialogue component of the mixture signal in order to guide the separation process. More particularly, the guide signals correspond to a recording of the voice of a speaker dubbing the target dialogue component that is to be separated. The document P. Smaragdis and G. Mysore "Separation by Humming: User-Guided Sound Extraction from Monophonic Mixture," in Workshop on Applications of Signal Processing to Audio and Acoustics, New Paltz, N.Y., USA, October 2009 proposed such an approach. In this document, the authors use a process based on Probabilistic Latent Component Analysis (PLCA). This process uses a guide signal that mimics the dialogue component to be extracted from the audio mixture signal and is set as an input to the PLCA.

The document by L. Le Magoarou et al. "Text-Informed Audio Source Separation Using Nonnegative Matrix Partial Co-Factorization," in IEEE International Workshop on Machine Learning for Signal Processing, Southampton, UK, September 2013 divulges an algorithm, based on a source-filter model for vocal production in the dialogue contribution of the mixture signal and in the guide signal, that models time misalignments and equalization differences but does not model pitch differences between a guide signal and the dialogue contribution of the mixture signals.

SUMMARY OF THE INVENTION

A method is described herein for transforming an audio mixture signal data structure x(t) representing an audio mixture signal having a specified component and a background component into a data structure corresponding to the specified component and a data structure corresponding to the background component, the method including obtaining a guide signal data structure g(t) corresponding to a dubbing of the specified component and storing the guide signal data structure g(t) at a computer readable medium, modeling, by a first modeling module, a spectrogram of a specified signal data structure y(t) as a parametric spectrogram data structure $\hat{V}_p^y$ having a plurality of frames and including, for each of the plurality of frames, a parameter that models a pitch difference between the guide signal data structure g(t) and the specified component, modeling, by a second modeling module, a spectrogram of a background signal data structure z(t) as a parametric spectrogram data structure $\hat{V}_p^z$, estimating, by an estimating module, the parameters of the parametric spectrogram data structure $\hat{V}_p^y$ to produce a temporary specified signal spectrogram data structure $V_i^y$ for the specified signal data structure y(t), estimating, by the estimating module, the parameters of the parametric spectrogram data structure $\hat{V}_p^z$ to produce a temporary background signal spectrogram data structure $V_i^z$ for the background signal data structure z(t), obtaining, from the audio mixture signal data structure x(t), an audio mixture signal constant Q transform (CQT) data structure $V^x$ and storing the CQT data structure $V^x$ at the computer readable medium, and filtering, to provide a specified audio signal CQT data structure $V^y$ and a background audio signal CQT data structure $V^z$, the audio mixture signal CQT $V^x$ using the temporary specified signal spectrogram $V_i^y$ and the temporary background signal spectrogram $V_i^z$, wherein the specified audio signal CQT data structure $V^y$ is the data structure corresponding to the specified component, and wherein the background audio signal CQT data structure $V^z$ is the data structure corresponding to the background component.

A system is described herein for transforming an audio mixture signal data structure x(t) representing an audio mixture signal having a specified component and a background component into a data structure corresponding to the specified component and a data structure corresponding to the background component, the system including a spectrogram computation module configured to apply a time-frequency transform to the audio mixture signal data structure x(t) to produce an audio mixture signal spectrogram data structure $V^x$, and apply a time-frequency transform to the audio guide signal data structure g(t) to produce an audio guide signal spectrogram data structure $V^g$, a first modeling module configured to model a spectrogram of a specified signal data structure y(t) corresponding to the specified component as a parametric spectrogram data structure $\hat{V}_p^y$ having a plurality of frames and including, for each of the plurality of frames, a parameter that accounts for a pitch difference between the audio guide signal data structure g(t) and the specified component, a second modeling module configured to model a spectrogram of a background audio signal data structure z(t) corresponding to the background component as a parametric spectrogram data structure $\hat{V}_p^z$, an estimation module configured to produce a temporary specified signal spectrogram data structure $V_i^y$ by estimating values for the parameters of the model parametric spectrogram data structure $\hat{V}_p^y$, and produce a temporary background audio signal spectrogram data structure $V_i^z$ by estimating values for parameters of the model parametric spectrogram data structure $\hat{V}_p^z$, and a filtering module configured to filter an audio mixture signal CQT data structure $V^x$ using the temporary specified signal spectrogram data structure $V_i^y$ and the temporary background signal spectrogram data structure $V_i^z$ to provide a specific audio signal CQT data structure $V^y$ and an audio background signal data structure CQT $V^z$, wherein the specified audio signal CQT data structure $V^y$ is the data structure corresponding to the specified component, and wherein the background audio signal CQT data structure $V^z$ is the data structure corresponding to the background component.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION OF THE DRAWINGS

Figure 1:
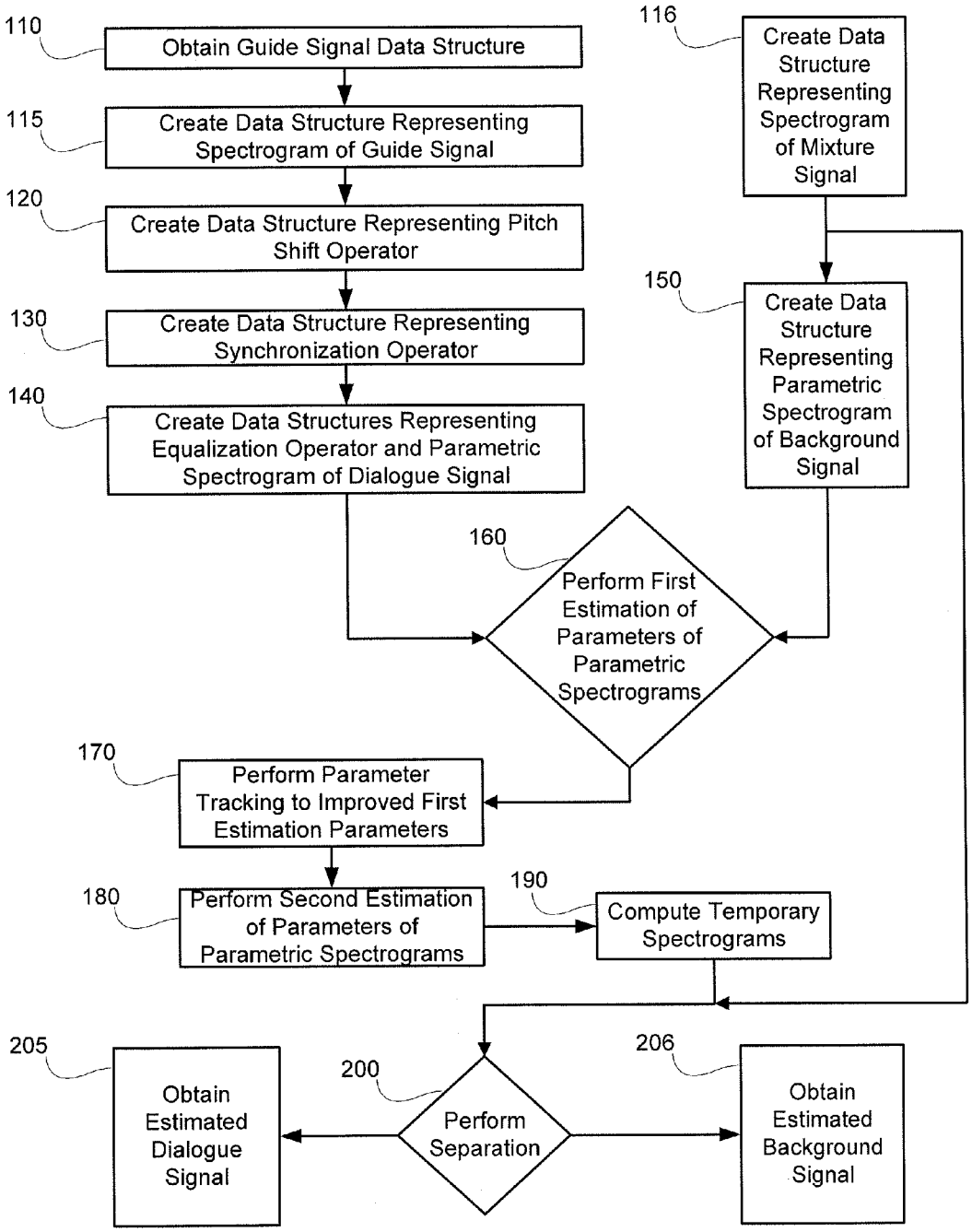
FIG. 1 is a flow diagram representation of a process for transforming an audio mixture signal data structure into isolated audio component signal data structures according to one implementation of the invention.

FIG. 1 is a flow diagram representation of a process 100 for transforming an audio mixture signal data structure into isolated audio component signal data structures according to one implementation of the invention. All references to signals throughout the remainder of the description of FIG. 1 are references to audio signals, and therefore the adjective "audio" may be omitted when referring to the various signals. Furthermore, in the description of the implementation depicted in FIG. 1, it is contemplated that the audio signals are monophonic signals. However, alternative implementations of the invention contemplate transforming stereophonic and multichannel audio signals. Those skilled in the art know how to adapt the processing presented in the description of FIG. 1 in detail herein to process stereophonic or multichannel signals. For example, an extra panning parameter can be used in a model dialogue signal data structure.

The process 100 transforms an audio mixture signal data structure x(t) by using a guide signal data structure g(t) in order to provide a dialogue signal data structure y(t) and a background signal data structure z(t), all of which are functions of time. In the filtering process depicted in FIG. 1, the mixture signal data structure x(t) is a representation, stored on a computer readable medium, of acoustical waves that constitute a source soundtrack or an excerpt of a source soundtrack. The mixture signal data structure x(t) represents acoustical waves that comprise at least a first component and a second component. The first component corresponds to a dialogue composed of speech provided by one or more original speakers, and the second component corresponds to what can be referred to as audio background and is composed of special audio effects, music, etc. The guide signal data structure g(t) of is a representation, stored on a computer readable medium, of acoustical waves that constitute the same dialogue of speech to which the first component corresponds but that is provided by one or more different speakers (i.e. dubbing speakers) instead of the original speakers. In other words, the guide signal data structure g(t) is a representation of acoustical waves that constitute a dubbing, provided by one or more dubbing speakers, of the dialogue to which the first component corresponds. The dialogue signal data structure y(t) of FIG. 1 is a representation, stored on a computer readable medium, of acoustical waves that represent the first component of the acoustical waves represented by the mixture signal data structure x(t) (i.e. a representation of the original dialogue) isolated from the remaining components of the acoustical waves represented by the mixture signal data structure x(t). The background signal data structure z(t) of FIG. 1 is a representation, stored on a computer readable medium, of acoustical waves that represent the second component of the acoustical waves represented by the mixture signal data structure x(t) (i.e. a representation of the original audio background) isolated from the remaining components of the acoustical waves represented by the mixture signal data structure x(t).

At 110, the process obtains the guide signal g(t) by, for example, recording a dubbing of the dialogue to which the first component of the mixture signal x(t) corresponds and creating a data structure representing the dubbing at a computer readable medium.

At 115, the process creates a data structure representing a log-frequency spectrogram $V^g$ of the guide signal g(t) at a computer readable medium. The log-frequency spectrogram $V^g$ is defined as the squared modulus of the constant-Q transform (CQT) of the guide signal g(t). In order to avoid any confusion, it is preferable to distinguish non-negative matrices (obtained from squared modulus of a CQT) and complex matrices (obtained from the CQT directly). In the remainder of this document, the term "spectrogram" denotes a non-negative matrix and the term "constant-Q transform," or "CQT," denotes a complex matrix. The process uses an algorithm to facilitate a transform from the time domain to the frequency domain, in such a way that central frequencies $f_c$ of each frequency bin are distributed on a logarithmic scale and the quality factors Q of each bin are constant. The quality factor Q of a frequency bin is provided by the equation $$Q = \frac{f_c}{\Delta f},$$

where $f_c$ is the central frequency of the bin and $\Delta f$ is the width of the bin.

At 116, the process creates a data structure representing a spectrogram $V^x$ of the audio mixture signal x(t) at a computer readable medium in the same manner in which the spectrogram $V^g$ of the guide signal g(t) was created at 115.

Assuming that the mixture signal x(t) and the guide signal g(t) have the same duration, the spectrograms $V^g$ and $V^x$ are both F×T matrices where T corresponds to a total number of frames that subdivide the total duration of the mixture signal x(t) and the guide signal g(t). If the guide signal g(t) and the mixture signal x(t) do not have the same duration, a synchronization matrix S having dimensions T'×T (where T' is the duration of matrix $V^g$ and T the duration of matrix $V^x$) can be used to perform a time modification on $V^g$.

In the process of FIG. 1, the spectrogram $V^x$ is modelled as a sum of a spectrogram of the dialogue signal, identified as $\hat{V}^y$, and a spectrogram of the audio background signal, identified as $\hat{V}^z$. Note that the nomenclature $\hat{a}$ denotes an estimation of a. In this manner, the process creates data structures representing models of the output spectrograms $\hat{V}^y$ and $\hat{V}^z$ where the output spectrograms have the property:

$$V^x \approx \hat{V}^y + \hat{V}^z \tag{1}$$

As the guide signal g(t) is not identical to the dialogue signal y(t), there are differences between the guide signal g(t) and the dialogue component of the mixture signal x(t) that must be modeled in order to account for them in the separation process. A parametric spectrogram $\hat{V}_p^y$ enables the differences between the spectrogram of the guide signal $V^g$ and the dialogue component of the spectrogram of the mixture signal $V^x$ to be modeled. Determining values for the parameters of the parametric spectrogram $\hat{V}_p^y$ provides the estimated spectrogram of the dialogue signal $\hat{V}^y$ in equation (1). The parametric spectrogram $\hat{V}_p^y$ is determined by performing three types of operation on the spectrogram of the guide signal $V^g$. First, a pitch shift operator is applied in order to account for pitch difference between the guide signal g(t) and the dialogue component of the mixture signal x(t) within a frame. Next, a synchronization operator is applied in order to account for temporal misalignment of frames of the guide signal and corresponding frames of the dialogue component of the mixture signal x(t). Finally, an equalization operator is applied to permit an adjustment that accounts for global spectral differences, or equalization differences, between the guide signal g(t) and the mixture signal x(t). In these operations, all corresponding parameters can be constrained to be non-negative.

At 120, a data structure representing a pitch shift operator P is created at a computer readable medium and applied to the spectrogram $V^g$ to produce a pitch-shifted spectrogram $V_{shifted}^g$, for which another data structure is created at a computer readable medium. In a time-frequency representation of an audio signal, a pitch modification of a sound corresponds to a simple shift along a frequency axis of a spectrogram, or at least to a simple shift along the frequency axis for a single frame of the spectrogram. The pitch shift operator P is a Φ×T matrix that applies a vertical shift to each frame of the spectrogram of the guide signal $V^g$. It is worth noting that a frame of a spectrogram corresponds to sampling period of a time-dependent signal. For spectrograms computed with a CQT, a vertical shift of a frame corresponds to a pitch modification as previously mentioned herein above. This operation can be written as:

$$V_{shifted}^g = \Sigma_\phi {}^{\downarrow\phi}V^g \mathrm{diag}(P_{\phi,:}) \tag{2}$$

where ${}^{\downarrow\Phi}V^g$ corresponds to a shift of the spectrogram $V^g$ of ϕ bins down (i.e. $[{}^{\downarrow\Phi}V^g]=[V^g]_{f-\phi,t}$) and $\mathrm{diag}(P_{\phi,:})$ is the diagonal matrix which has the coefficients of the $\phi^{th}$ row of P as a main diagonal.

The pitch shift operator P is a model for a difference between the instant pitch of the guide signal g(t) and the one of the dialogue component of the mixture signal x(t). In practice, only one pitch shift ϕ must be retained for each frame t. To achieve this, a selection procedure will be applied as described below.

At 130, a data structure is created at a computer readable medium for a synchronization operator S, which is applied to the pitch-shifted spectrogram $V_{shifted}^g$ to produce a pitch-shifted and synchronized spectrogram $V_{sync}^g$, for which a data structure is also created. The synchronization operator S is a T'×T matrix that models a temporal misalignment of the spectrogram of the guide signal $V^g$ and the dialogue component of the spectrogram of the mixture signal $V^x$. A time frame of the spectrogram of the mixture signal $V^x$ is modeled as a linear combination of the previous and following frames of the pitch-shifted spectrogram $V_{shifted}^g$. This operation can be written as:

$$V_{sync}^g = V_{shifted}^g S \tag{3}$$

where S is a band matrix, i.e. there exists a positive integer w such that, for all pairs of frames $(t_1, t_2)$, where $|t_1\ t_2|>w$, $S_{t_1 t_2}=0$.

The bandwidth w of the matrix S corresponds to the misalignment tolerance between frames of the guide signal and frames of the dialogue component of the mixture signal. A large value of w allows a large tolerance but at the cost of quality of estimation of the model parameters. Limiting w to a small number of time frames can therefore be advantageous. The correct synchronization can also be optimized with a selection procedure that will be described below.

At 140, the process creates data structures representing the parametric spectrogram of the dialogue signal $\hat{V}_p^y$ and an equalization operator E, which is an F×1 vector, at a computer readable medium. The equalization operator E models global spectral differences, or equalization differences, between the guide signal g(t) and the mixture signal x(t) and is modeled as a global filter on the pitch-shifted and synchronized spectrogram $V_{sync}^g$ such that the parametric spectrogram of the dialogue signal $\hat{V}_p^y$, can be modeled as:

$$\hat{V}_p^y = \mathrm{diag}(E)(\Sigma_\phi {}^{\downarrow\phi}V^g \mathrm{diag}(P_{\phi,:}))S \tag{4}$$

where diag(E) is a diagonal matrix which has the coefficients of E as a main diagonal.

At 150, as no information on the content of the audio background signal z(t) is available, a parametric spectrogram of the audio background signal $V_p^z$ is modeled from a standard NMF, and a data structure representative of $V_p^z$ is created and stored at a computer readable medium. In this manner, the spectrogram of the audio background signal $\hat{V}^z$ is parametrically modeled as:

$$\hat{V}_p^z = WH \tag{5}$$

where W is an F×R non-negative matrix and H is an R×T non-negative matrix. R is constrained to be far less than F and T. The choice of R is important and application-dependent. Columns of W can be considered as elementary spectral shapes and H can be considered to be a matrix for activation of the elementary spectral shapes over time. At 150, the process also creates data structures for W and H and stores the data structures at a computer readable medium.

At 160, the process performs a first estimation of the parameters of model parametric spectrograms $\hat{V}_p^y$ and $\hat{V}_p^z$ and updates the data structures representative of the model parametric spectrograms $\hat{V}_p^y$ and $\hat{V}_p^z$ and of their parameters accordingly. For the first estimation, all parameters can be initialized with random non-negative values. In order to estimate the parameters of the spectrograms $\hat{V}_p^y$ and $\hat{V}_p^z$, a cost function C, based on an element-wise divergence d, is used:

$$C=D(V|\hat{V}_p^y+\hat{V}_p^z)=\Sigma_{f,t}d(v_{ft}|\hat{v}_{ft}^y+\hat{v}_{ft}^z) \tag{6}$$

An implementation is herein contemplated in which the Itakura-Saito divergence, well known to those skilled in the art, is used. It is written as:

$$d(a\,|\,b)=\frac{a}{b}-\frac{\log a}{b}-1 \tag{7}$$

The cost function C is minimized in order to determine the optimal value of each parameter. This minimization is done iteratively, with multiplicative update rules that are successively applied to each parameter of the model spectrograms: W, H, E, S, and P.

The update rules can be derived from the gradient of the cost function C with respect to each parameter. Specifically, the gradient of the cost function with respect to a selected parameter can be written as the difference of two non-negative terms, and the corresponding update rule is then the element-wise multiplication of the selected parameter by the element-wise ratio of both these terms. This ensures that parameters remain non-negative for each update and become constant if the gradient of the cost function with respect to the selected parameter is zero. In this manner, the parameters approach a local minimum of the cost function.

The update rules of the parameters of the parametric spectrogram of the dialogue signal $\hat{V}_p^y$ can be written:

$$E \leftarrow \frac{E \odot \left(\left(\sum_{\phi} {}^{\downarrow\phi}V^g \operatorname{diag}(P_{\phi,:})S\right) \odot V \odot \hat{V}^{\odot -2}\right)1_T}{\left(\left(\sum_{\phi} {}^{\downarrow\phi}V^g \operatorname{diag}(P_{\phi,:})S\right) \odot \hat{V}^{\odot -1}\right)1_T} \tag{8}$$

$$S \leftarrow \frac{S \odot \left(\sum_{\phi} \operatorname{diag}(E)\,{}^{\downarrow\phi}V^g \operatorname{diag}(P_{\phi,:})\right) \odot V \odot \hat{V}^{\odot -2}}{\left(\sum_{\phi} \operatorname{diag}(E)\,{}^{\downarrow\phi}V^g \operatorname{diag}(P_{\phi,:})\right)} \tag{9}$$

$$P_{\phi,:} \leftarrow P_{\phi,:} \odot \frac{E^T\left({}^{\downarrow\phi}V^g \odot \left(\left(V \odot \hat{V}^{\odot -2}\right)S^T\right)\right)}{E^T\left({}^{\downarrow\phi}V^g \odot \left(V \odot \hat{V}^{\odot -1}S^T\right)\right)} \tag{10}$$

where $\odot$ is an operator that corresponds to an element-wise product between matrices (or vectors); $.^{\odot(.)}$ is an operator that corresponds to element-wise exponentiation of a matrix by a scalar; $(.)^T$ is a matrix transposition; and $1_T$ is a T×1 vector with all coefficients equal to 1.

The update rules for W and H are the standard multiplicative update rules for NMF with a cost function based on Itakura-Saito divergence. For instance, the document by C. Févotte et al., "Nonnegative matrix factorization with the Itakura-Saito divergence, with application to music analysis," Neural Computation, vol. 11, no. 3, pp. 793-830, March 2009, describes such update rules.

At 170, the process enters a tracking step, particularly, of parameters of the pitch shift operator P. A frame of the spectrogram $V^y$ is modeled (up to an equalization operator and a synchronization operator) as a linear combination of the corresponding frame of the spectrogram $V^g$ pitch-shifted with different pitch shift values. In order to describe a global pitch shift, only one pitch shift must be retained for each frame. The tracking step aims at determining this unique shift value for every frame. To do so, a method of pitch shift tracking in matrix P is used. The Viterbi algorithm, which is well known by those skilled in the art, can be applied to matrix P after the first estimation at 160. For instance, the document J.-L. Durrieu et al, "An iterative approach to monaural musical mixture de-soloing," in International Conference on Acoustics, Speech, and Signal Processing (ICASSP), Taipei, Taiwan, April 2009, pp. 105-108, describes such a tracking algorithm. Then, once the optimal pitch shift is selected for each frame, the coefficients of matrix P that do not correspond to this pitch shift are set to 0 to provide an optimized pitch shift matrix $P_{opt}$, and a data structure representative of $P_{opt}$ is created at a computer readably medium.

In practice, one can allow a small margin around the optimal pitch shift in order to achieve advantages attributable to several factors. First, pitch shifts are quantified in this process, but they are physically continuous. Second, the tracking algorithm may produce small errors. Then, the non-zero area of matrix P is smoothed around the optimal pitch shift value. In alternative implementations, the synchronization matrix S is optimized using a tracking method adapted to the optimization of the parameters of that operator.

At 180, the process performs a second estimation of the parametric spectrograms $\hat{V}_p^y$ and $\hat{V}_p^z$. The second estimation is similar to the estimation performed at 160 but instead of initializing the operators with random values, the operators are initialized with the values obtained from the first estimate optimization at 170. It is worth noting that, since update rules are multiplicative, coefficients of P (and of S) initialized to 0 will remain 0 during the second estimation. At 190, temporary spectrograms $\hat{V}_i^y$ and $\hat{V}_i^z$ are computed with the parameter values obtained from the second estimation at 180.

At 200, separation is performed by means of Wiener filtering on the CQT of the mixture signal $V^x$ using temporary spectrograms $\hat{V}_i^y$ and $\hat{V}_i^z$. This way, one obtains the CQT of the estimated dialogue signal $V^y$ and the CQT of the estimated audio background signal $V^z$. At 205 and 206, the estimated dialogue signal x(t) and the estimated background signal z(t) are obtained from the CQT of the estimated dialogue signal $V^y$ and the CQT of the estimated audio background signal $V^z$, respectively, using a transform that is the inverse of the transform used at 115 and 116.

Figure 2:
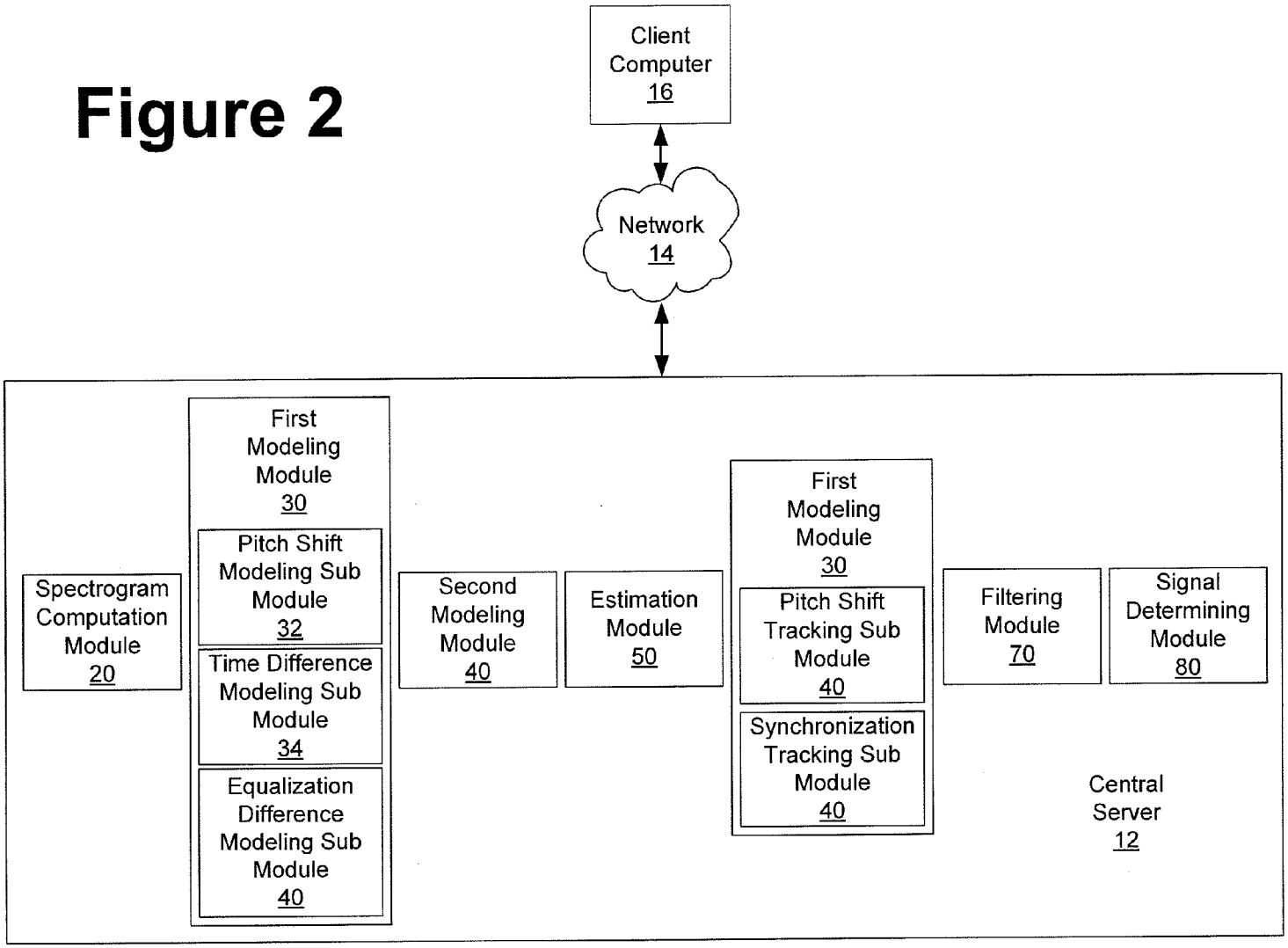
FIG. 2 is a schematic diagram of a system for transforming an audio mixture signal data structure into isolated audio component signal data structures according to one embodiment of the invention.

FIG. 2 is a schematic diagram of a system for transforming an audio mixture signal data structure into isolated audio component signal data structures according to one embodiment of the invention. The system depicted in FIG. 2 comprises a central server 12 connected, through a communication network 14 (e.g. the Internet) to a client computer 16. The schematic diagram depicted in FIG. 2 is only one embodiment of the present invention, and the present invention also contemplates systems for filtering audio mixture signals in order to provide isolated component signals that have a variety of alternative configurations. For example, the present invention contemplates systems that reside entirely at a client computer or entirely at a central server as well as alternative configurations where the system is distributed between a client computer and a central server.

In the embodiment depicted in FIG. 2, the client computer 16 runs an application that enables a user to select a mixture signal x(t), to listen to the selected mixture signal x(t), and to record a dubbed dialogue corresponding to the selected soundtrack that is to be used as the guide signal g(t). The mixture soundtrack can be obtained through the communication network 14, for instance, from an online database via the Internet. Alternatively, the mixture soundtrack can be obtained from a computer readable medium located locally at the client computer 16. Similarly, if the dubbed dialogue corresponding to the selected soundtrack has previously been recorded, the guide signal g(t) can be obtained through the communication network 14 from an online database via the Internet or can be obtained from a computer readable medium located locally at the client computer 16. In the embodiment depicted by FIG. 2, the mixture signal x(t) and the guide signal g(t) can be relayed, through the Internet, to the central server 12.

The central server 12 includes means of executing computations, e.g. one or more processors, and computer readable media, e.g. non-volatile memory. The computer readable media can store processor executable instructions for performing the process 100 depicting in FIG. 1. The means of executing computations included at the server 12 include a spectrogram computation module 20 configured to produce a log-frequency spectrogram data structure $V^g$ from the guide signal data structure g(t) (in a manner such as that described in connection with element 115 of FIG. 1) and a log-frequency spectrogram data structure $V^x$ from the mixture signal data structure x(t) (in a manner such as that described in connection with element 116 of FIG. 1).

The server 12 also includes a first modeling module 30 configured to obtain (in a manner such as that described in connection with elements 120, 130, and 140 of FIG. 1), from the spectrogram data structure $V^g$, a parametric spectrogram data structure $\hat{V}_p^y$ that models the spectrogram of the dialogue signal. The first modeling module 30 includes a pitch-shift modeling sub-module 32 configured to model a pitch shift operator P (in a manner such as that described in connection with element 120 of FIG. 1), a time-difference modeling sub-module 34 configured to model a time synchronization operator S (in a manner such as that described in connection with element 130 of FIG. 1), and an equalization difference modeling sub-module 36 configured to model an equalization operator E (in a manner such as that described in connection with element 140 of FIG. 1). The central server 12 further includes a second modeling module 40 configured to obtain (in a manner such as that described in connection with element 150 of FIG. 1), from the spectrogram $V^x$ of the mixture signal x(t), a parametric spectrogram $\hat{V}_p^z$ that models the spectrogram of the audio background signal.

In addition, the central server 12 includes an estimation module 50 configured to estimate the parameters of the parametric spectrogram data structures $\hat{V}_p^y$ and $\hat{V}_p^z$ using the spectrogram data structure $V^x$. The estimation module 50 is configured to perform a first estimation (in a manner such as that described in connection with element 160 of FIG. 1) in which all values of the parameters of the parametric spectrogram data structures $\hat{V}_p^y$ and $\hat{V}_p^z$ are initialized using random non-negative values. The estimation module 50 is further configured to perform a second estimation (in a manner such as that described in connection with element 180 of FIG. 1) in which all values of the parameters of the parametric spectrogram data structures $\hat{V}_p^y$ and $\hat{V}_p^z$ are initialized using optimized first estimation values. In addition, the estimation module 50 is configured to compute temporary spectrogram data structures with the parameters obtained from the second estimation. For example, the estimation module 50 is configured to compute temporary spectrogram data structures in a manner such as that described in connection with element 190 of FIG. 1.

The central server 12 further includes a tracking module 60 configured to perform a tracking step, such as that described in connection with element 170 of FIG. 1. The tracking module 60 includes a pitch shift tracking sub-module 62 for tracking pitch shift in the pitch shift operator P and a synchronization tracking sub-module 64 for tracking alignment in the synchronization operator S.

Furthermore, the central server 12 includes a filtering module 70 configured to implement Weiner filtering for determining the spectrogram data structure $\hat{V}^y$ of the dialogue signal data structure y(t) and the spectrogram data structure $\hat{V}^z$ of the background signal data structure z(t) from the optimized parameters in a manner such as that described in connection with element 200 of the process described by FIG. 1. Finally, the central server 12 includes a signal determining module 80 configured to determine the dialogue signal data structure y(t) from the spectrogram data structure $\hat{V}^y$ (in a manner such as that described in connection with element 205 of FIG. 1) and to determine the background signal data structure z(t) from the spectrogram data structure $\hat{V}^z$ (in a manner such as that described in connection with element 206 of FIG. 1). The central server 12, after processing the provided signals and obtaining the dialogue signal data structure y(t) and the audio background signal data structure z(t), can transmit both output signal data structures to the client computer 16.

Figure 3:
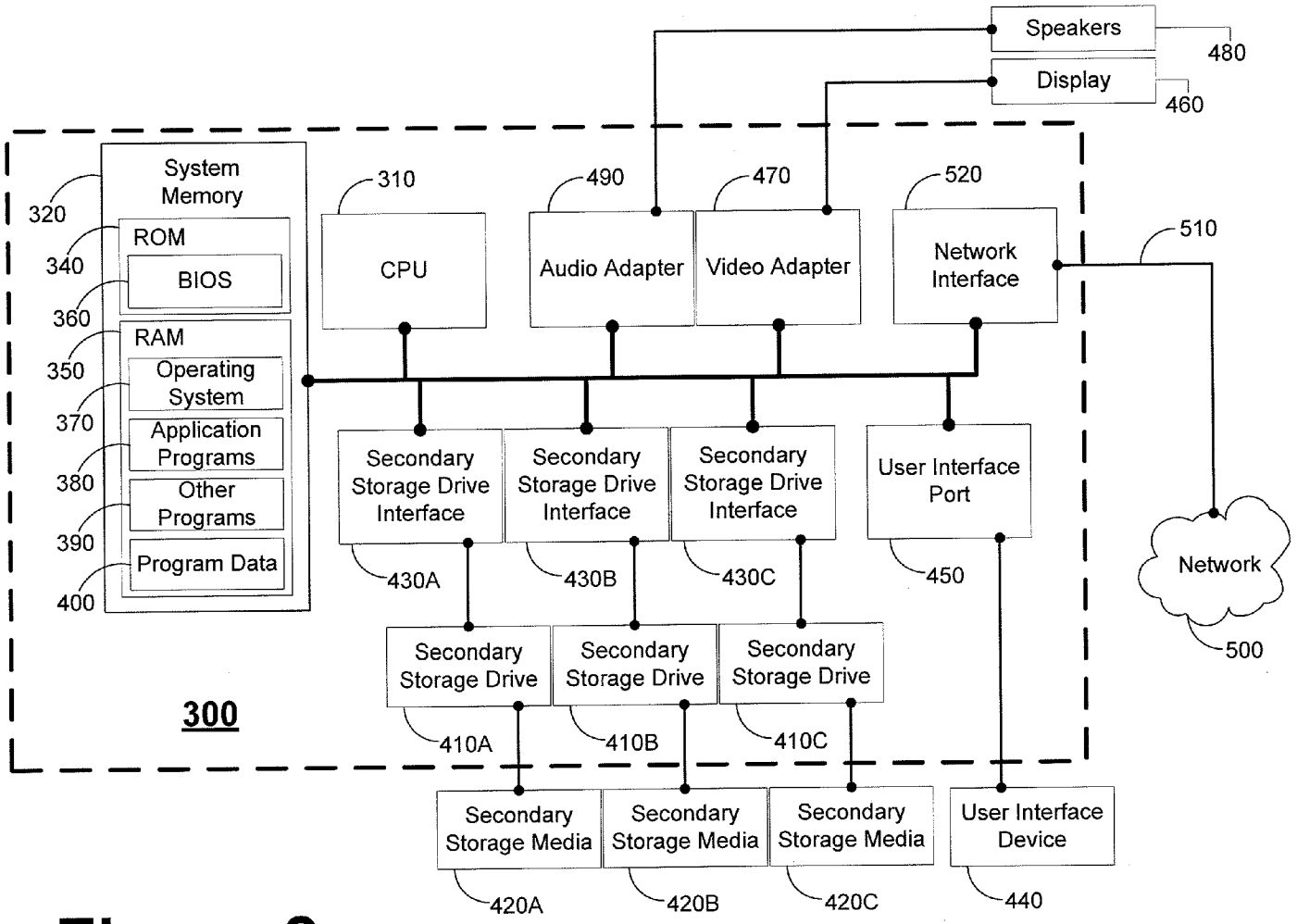
FIG. 3 is a block diagram illustrating an example computer environment at which the system for transforming an audio mixture signal data structure into isolated audio component signal data structures of FIG. 2 may reside.

FIG. 3 is a block diagram illustrating an example of the computer environment in which the system for transforming an audio mixture signal data structure into a component audio signal data structures of FIG. 2 may reside. Those of ordinary skill in the art will understand that the meaning of the term "computer" as used in the exemplary environment in which the present invention may be implemented is not limited to a personal computer but may also include other microprocessor or microcontroller-based systems. For example, the present invention may be implemented in an environment comprising hand-held devices, smart phones, tablets, multi-processor systems, microprocessor based or programmable consumer electronics, network PCs, mini-computers, mainframe computers, Internet appliances, and the like.

The computer environment includes a computer 300, which includes a central processing unit (CPU) 310, a system memory 320, and a system bus 330. The system memory 320 includes both read only memory (ROM) 340 and random access memory (RAM) 350. The ROM 34 stores a basic input/output system (BIOS) 360, which contains the basic routines that assist in the exchange of information between elements within the computer, for example, during start-up. The RAM 350 stores a variety of information including an operating system 370, an application programs 380, other programs 390, and program data 400. The computer 300 further includes secondary storage drives 410A, 410B, and 410C, which read from and writes to secondary storage media 420A, 420B, and 420C, respectively. The secondary storage media 420A, 420B, and 420C may include but is not limited to flash memory, one or more hard disks, one or more magnetic disks, one or more optical disks (e.g. CDs, DVDs, and Blu-Ray discs), and various other forms of computer readable media. Similarly, the secondary storage drives 410A, 410B, and 410C may include solid state drives (SSDs), hard disk drives (HDDs), magnetic disk drives, and optical disk drives. In some implementations, the secondary storage media 420A, 420B, and 420C may store a portion of the operating system 370, the application programs 380, the other programs 390, and the program data 400.

The system bus 330 couples various system components, including the system memory 320, to the CPU 310. The system bus 330 may be of any of several types of bus structures including a memory bus or memory controller, a peripheral bus, and a local bus using any of a variety of bus architectures. The system bus 330 connects to the secondary storage drives 410A, 410B, and 410C via a secondary storage drive interfaces 430A, 430B, and 430C, respectively. The secondary storage drives and their associated computer-readable media provide nonvolatile storage of computer readable instructions, data structures, programs, and other data for the computer 300.

A user may enter commands and information into the computer 300 through user interface device 440. User interface device 440 may be but is not limited to any of a microphone, a touch screen, a touchpad, a keyboard, and a pointing device, e.g. a mouse or a joystick. User interface device 440 is connected to the CPU 310 through port 450. The port 450 may be but is not limited to any of a serial port, a parallel port, a universal serial bus (USB), a 1394 bus, and a game port. The computer 300 may output various signals through a variety of different components. For example, in FIG. 3 a graphical display 460 is connected to the system bus 330 via video adapter 470. The environment in which the present invention may be carried out may also include a variety of other peripheral output devices including but not limited to speakers 480, which are connected to the system bus 330 via audio adaptor 490.

The computer 300 may operate in a networked environment by utilizing connections to one or more devices within a network 500, including another computer, a server, a network PC, a peer device, or other network node. These devices typically include many or all of the components found in the example computer 300. For example, the example computer 300 depicted in FIG. 3 may correspond to the client computer 16 depicted in FIG. 2. Similarly, the example computer 300 depicted in FIG. 3 may also be representative of the central server 12 depicted in FIG. 2. In FIG. 3, the logical connections utilized by the computer 300 include a network link 510. Possible implementations of the network link 510 include a local area network (LAN) link and a wide area network (WAN) link, such as the Internet. The computer 30 is connected to the network 500 through a network interface 520. Data may be transmitted across the network link 510 through a variety of transport standards including but not limited to Ethernet, SONET, DSL, T-1, T-3, and the like via such physical implementations as coaxial cable, twisted copper pairs, fiber optics, and the like. In a networked environment in which the present invention may be practiced, programs or portions thereof executed by the computer 30 may be stored on other devices connected to the network 500.

Comparative tests were performed to compare separation results of the process described in FIG. 1 with other known processes. The first known process was based on a NMF method that includes a vocal source-filter mode without guiding information. The second known process was a separation process based on a PLCA informed by a guide signal that corresponds to an imitation of the dialogue contribution of the mixture signal. The third known process is similar to the first one, but uses a frame-by-frame pitch annotation as guide information (such annotation is done manually and is thus tedious and costly).

A database of soundtracks was made for the testing. Soundtracks in the database were constructed by adding a soundtrack including a dialogue (in English) with a soundtrack including only music and audio effects. This way, the contributions of each component of the mixture signal are well known. The database can be, e.g., made of ten such soundtracks. In order to obtain a guide signal, each soundtrack was dubbed using the corresponding mixture signal as a time reference. All dubbings were recorded by the same male native English speaker.

The guide signals were used for both the process of the present invention and the second known process. Spectrograms were computed using a CQT with a minimum frequency $f_{min}$=40 Hz, a maximum frequency $f_{max}$=16000 Hz, and 48 bins per octave. In order to quantify the results obtained for each known process and for the process of the present invention, standard source separation metrics were computed. These metrics are the signal to distortion ratio (SDR), the signal to artifact ratio (SAR) and the signal to interference ratio (SIR).

Figure 4:
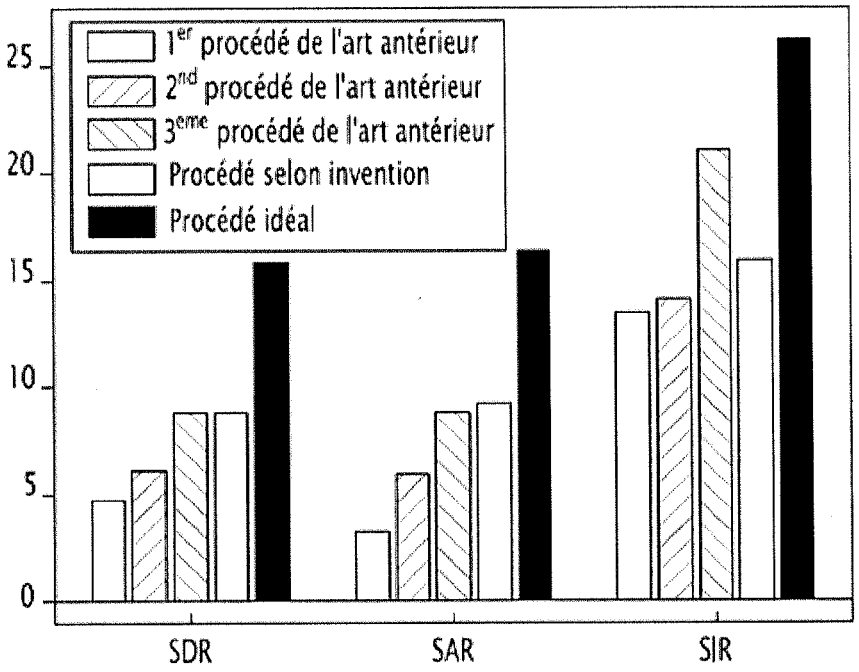
FIG. 4 is a graph providing results of audio mixture separation tests of a process according to an implementation of the present invention and of various processes of the prior art.
Figure 5:
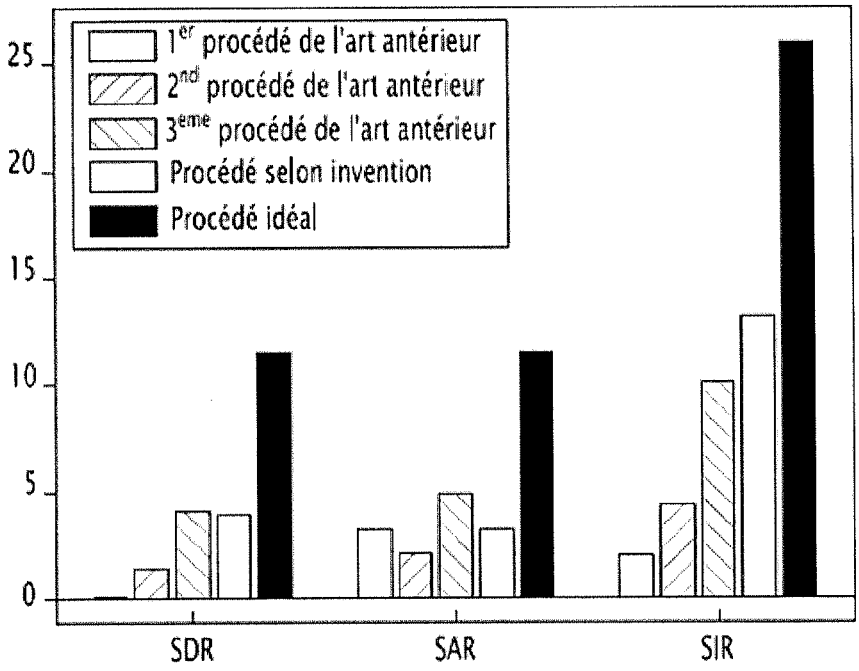
FIG. 5 is a graph providing results of audio mixture separation tests of a process according to an implementation of the invention and various processes of the prior art.

Results are presented in FIG. 4 for the dialogue signal and FIG. 5 for the background signal. In these figures, the three first bars correspond to the three known processes, the fourth bar corresponds to the process of the present invention, and the fifth bar is an ideal estimation case where the original dialogue and background soundtracks used to build the mixture soundtrack are directly used as input of the Wiener filtering step. This last last case should thus be considered as an upper performance bound. Results of the first process are significantly lower than any informed process, which confirms the benefits of informed methods. The second known process, which uses exactly the same information as the process of the present invention, performs significantly worse than the third known process and the process of the present invention.

The differences between the third known process and the process of the present invention are less clear: differences in terms of SDR are not significant. Results in terms of SAR and SIR are roughly the opposite for the dialogue extraction task and the dialogue removal task. However, other qualitative metrics indicate an advantage to the process of the present invention. A blind listening test based on the MUSHRA protocol was performed and listeners were asked to rate the "usability" of each sound for the dialog extraction task only for the results of the third known process and the process of the present invention. The results of the process of the present invention were globally preferred by the listeners. Moreover, it is worth noting that the process of the current invention does not require the tedious and costly pitch annotation required by the third known process.

As an alternative, other systems can implement the process of the present invention. The present implementation illustrates the particular case of the separation of a dialogue from a mixture signal, by adapting the spectrogram of the guide signal in pitch, in synchronization and in equalization, with a NMF method. However, the present process does not use a model that is specific to speech for the guide signal. The model used is generic and can thus be applied to broad classes of audio signals.

Consequently, the present process is also adapted to the separation from a mixture signal of any kind of specific contribution for which the user has at his disposal an audio guide signal. Such a guide signal can be another recording of the specific audio component of the mixture signal that can contain pitch differences, time misalignment and equalization differences. The present invention can model these differences and compensate for them during the separation process.

This way, instead of a voice, the specific contribution can also be the sound of a specific instrument in a music signal that mixes several instruments. The contribution of this specific instrument is played again and recorder to be used as a guide signal. Alternatively, the specific contribution can be a recording of the music that was used to create the soundtrack of an old movie. This recording has generally small playback speed differences (that imply both pitch differences and misalignment) an equalization differences with the music component of the original soundtrack of the music caused by old analog recording devices. This recording can be used as a guide signal in the present process, in order to extract both the dialogue and audio effects. A person skilled in the art will understand that the process of the document by L. Le Magoarou et al. does not permit the last two applications.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

Acts and operations described herein can include the execution of microcoded instructions as well as the use of sequential logic circuits to transform data or to maintain it at locations in the memory system of the computer or in the memory systems of a distributed computing environment. Programs executing on a computer system or being executed by parts of a CPU can also perform acts and operations described herein. A "program" is any instruction or set of instructions that can execute on a computer, including a process, procedure, function, executable code, dynamic-linked library (DLL), applet, native instruction, engine, thread, or the like. A program, as contemplated herein, can also include a commercial software application or product, which may itself include several programs. However, while the invention can be described in the context of software, that context is not meant to be limiting. Those of skill in the art will appreciate that various acts and operations described herein can also be implemented in hardware.

The invention claimed is:

1. An audio signal processing method for separating, by a system including one or more computer processors and non-transitory computer readable media, a specific audio component from a mixture of multiple audio components that includes the specified audio component and a background audio component, wherein the mixture of multiple audio components is represented by an audio mixture signal data structure x(t), the method comprising:

obtaining a guide signal data structure g(t) corresponding to a dubbing of the specified audio component and storing the guide signal data structure g(t) at the computer readable media;

modeling, by a first modeling module, a spectrogram of a specified signal data structure y(t) as a parametric spectrogram data structure $\hat{V}_p^y$ having a plurality of frames and including, for each of the plurality of frames, a parameter that models a pitch difference between the guide signal data structure g(t) and the specified audio component;

modeling, by a second modeling module, a spectrogram of a background signal data structure z(t) as a parametric spectrogram data structure $\hat{V}_p^z$;

estimating, by an estimating module, the parameters of the parametric spectrogram data structure $\hat{V}_p^y$ to produce a temporary specified signal spectrogram data structure $V_i^y$ for the specified signal data structure y(t);

estimating, by the estimating module, the parameters of the parametric spectrogram data structure $\hat{V}_p^z$ to produce a temporary background signal spectrogram data structure $V_i^z$ for the background signal data structure z(t);

obtaining, from the audio mixture signal data structure x(t), an audio mixture signal constant Q transform (CQT) data structure $V^x$ and storing the CQT data structure $V^x$ at the computer readable medium;

filtering, to provide a specified audio signal CQT data structure $V^y$ and a background audio signal CQT data structure $V^z$, the audio mixture signal CQT $V^x$ using the temporary specified signal spectrogram $V_i^y$ and the temporary background signal spectrogram $V_i^z$;

storing for playback or further processing, as a data structure representing the specified audio component at the computer readable media, the specified audio signal CQT data structure $V^y$; and storing for playback or further processing, as a data structure representing the background audio component at the computer readable media, the background audio signal CQT data structure $V^z$.

2. The audio signal processing method according to claim 1, further comprising:

applying a time-frequency transform to the audio mixture signal data structure x(t) to produce an audio mixture signal spectrogram data structure $V^x$;

applying a time-frequency transform to the guide signal data structure g(t) to produce a guide signal spectrogram data structure $V^g$;

applying an inverse time-frequency transform to the specific audio signal CQT data structure $V^y$ to produce a specified signal data structure y(t);

applying an inverse time-frequency transform to the background audio signal CQT data structure $V^z$ to produce a background signal data structure z(t).

3. The audio signal processing method of claim 1, wherein the parametric spectrogram data structure $\hat{V}_p^z$ is based on a non-negative matrix decomposition.

4. The audio signal processing method of claim 1, wherein the parametric spectrogram data structure $\hat{V}_p^y$ includes parameters that model a time shift between the guide signal data structure g(t) and the audio mixture signal data structure x(t).

5. The audio signal processing method of claim 1, wherein the parametric spectrogram data structure $\hat{V}_p^y$ includes parameters that model an equalization difference between the guide signal data structure g(t) and the audio mixture signal data structure x(t).

6. The audio signal processing method of claim 1, wherein both estimating parameters of the parametric spectrogram data structure $\hat{V}_p^y$ and estimating parameters of the parametric spectrogram data structure $\hat{V}_p^z$ are performed according to minimization of a cost function (C).

7. The audio signal processing method of claim 6, wherein the cost function (C) uses a divergence (d) that is the Itakura Saito divergence.

8. The audio signal processing method of claim 1, wherein estimating the temporary specified signal spectrogram data structure $V_i^y$ involves estimating parameters of a model parametric spectrogram data structure $V_{shifted}^g = \Sigma_\phi {}^{\downarrow\Phi}V^g \mathrm{diag}(P_{\phi,:})$;

wherein ${}^{\downarrow\Phi}V^g$ corresponds to a shift, to an audio guide signal spectrogram data structure $V^g$, of $\phi$ time/frequency points down, wherein P is a matrix data structure that includes the parameter, for each of the plurality of frames, that accounts for a pitch difference between the audio guide signal data structure g(t) and the specified component of the audio mixture signal data structure x(t);

and wherein $\mathrm{diag}(P_{\phi,:})$ is a diagonal matrix data structure having the components of the $\phi^{th}$ row of P as a main diagonal.

9. The audio signal processing method of claim 8, wherein estimating the temporary specified signal spectrogram data structure $V_i^y$ involves estimating parameters of a model parametric spectrogram data structure $V_{sync}^g = V_{shifted}^g S$;

wherein S is a matrix data structure that includes parameters for a correction of a time shift between the guide signal data structure g(t) and the audio mixture signal data structure x(t), and wherein there exists a positive integer w such that, for all pairs of frames $(t_1,t_2)$, where $|t_1-t_2|>w$, $S_{t_1t_2}=0$.

10. The audio signal processing method of claim 9, wherein the parametric spectrogram data structure $\hat{V}_p^y$ has the form $$\hat{V}_p^y = \mathrm{diag}(E)(\Sigma_\phi \phi^{\downarrow\Phi}V^g \mathrm{diag}(P_{\phi,:}))S;$$

wherein diag (E) is a diagonal matrix data structure that includes parameters for a correction of an equalization difference between the guide signal data structure g(t) and the audio mixture signal data structure x(t), and wherein estimating the temporary specified signal spectrogram data structure $V_i^Y$ involves estimating E, S, and P.

11. The audio signal processing method of claim 10, wherein estimating the temporary specified signal spectrogram data structure $V_i^y$ is iterative, wherein the update rule $$P_{\phi,:} \leftarrow P_{\phi,:} \odot \frac{E^T\left({}^{\downarrow\phi}V^g \odot \left(\left(V \odot \hat{V}^{\odot-2}\right)S^T\right)\right)}{E^T\left({}^{\downarrow\phi}V^g \odot \left(V \odot \hat{V}^{\odot-1}S^T\right)\right)}$$

is used for estimating the values of P, wherein the update rule $$S \leftarrow \frac{S \odot \left(\sum_\phi \mathrm{diag}(E)^{\downarrow\phi}V^g \mathrm{diag}(P_{\phi,:})\right) \odot V \odot \hat{V}^{\odot-2}}{\left(\sum_\phi \mathrm{diag}(E)^{\downarrow\phi}V^g \mathrm{diag}(P_{\phi,:})\right)}$$

is used for estimating the values of S, wherein the update rule $$E \leftarrow \frac{E \odot \left(\left(\sum_\phi {}^{\downarrow\phi}V^g \mathrm{diag}(P_{\phi,:})S\right) \odot V \odot \hat{V}^{\odot-2}\right)1_T}{\left(\left(\sum_\phi {}^{\downarrow\phi}V^g \mathrm{diag}(P_{\phi,:})S\right) \odot \hat{V}^{\odot-1}\right)1_T}$$

is used for estimating the values of E, and wherein $\odot$ is an operator that corresponds to an element-wise product between matrices (or vectors), $(.)^{\odot(.)}$ is an operator that corresponds to element-wise exponentiation of a matrix by a scalar, $(.)^T$ is a matrix transposition, and $1_T$ is a T×1 vector with all coefficients equal to 1.

12. The audio signal processing method of claim 1, wherein estimating the temporary specified signal spectrogram data structure $V_i^y$ includes:

performing a first estimation that provides, as output, values of each parameter of the model parametric spectrogram data structure $\hat{V}_p^y$, and performing a tracking step that provides an optimized first estimation value for each parameter of the model parametric spectrogram data structure $\hat{V}_p^y$.

13. The audio signal processing method of claim 12, wherein estimating the temporary specified signal spectrogram data structure $V_i^y$ further includes performing a second estimation in which values of each parameter of the model parametric spectrogram data structure $\hat{V}_p^y$ are initialized with the optimized first estimation values for each parameter.

14. The audio signal processing method of claim 1, wherein filtering the audio mixture signal CQT data structure $V^x$ is performed using Wiener filtering.

15. An audio signal processing system for separating a specified audio component from a mixture of multiple audio components that includes the specified audio component and a background audio component, wherein the mixture of multiple audio components is represented by an audio mixture signal data structure x(t), the system comprising:

non-transitory computer readable media; and one or more computer processors including;

a spectrogram computation module configured to:

apply a time-frequency transform to the audio mixture signal data structure x(t) to produce an audio mixture signal spectrogram data structure $V^x$, and apply a time-frequency transform to an audio guide signal data structure g(t) to produce an audio guide signal spectrogram data structure $V^g$;

a first modeling module configured to model a spectrogram of a specified signal data structure y(t) corresponding to the specified audio component as a parametric spectrogram data structure $\hat{V}_p^y$ having a plurality of frames and including, for each of the plurality of frames, a parameter that accounts for a pitch difference between the audio guide signal data structure g(t) and the specified audio component;

a second modeling module configured to model a spectrogram of a background audio signal data structure z(t) corresponding to the background audio component as a parametric spectrogram data structure $\hat{V}_p^z$;

an estimation module configured to:

produce a temporary specified signal spectrogram data structure $V_i^y$ by estimating values for the parameters of the model parametric spectrogram data structure $\hat{V}_p^y$, and produce a temporary background audio signal spectrogram data structure $V_i^z$ by estimating values for parameters of the model parametric spectrogram data structure $\hat{V}_p^z$;

a filtering module configured to filter an audio mixture signal CQT data structure $V^x$ using the temporary specified signal spectrogram data structure $V_i^y$ and the temporary background signal spectrogram data structure $V_i^z$ to provide a specific audio signal CQT data structure $V^y$ and an audio background signal data structure CQT $V^z$; and a signal determining module configured to store for playback or further processing, as a data structure representing the specified audio component at the computer readable media, the specified audio signal CQT data structure $V^y$, and to store for playback or further processing, as a data structure representing the background audio component at the computer readable media, the background audio signal CQT data structure $V^z$.

16. The audio signal processing system of claim 15, wherein the parametric spectrogram data structure $\hat{V}_p^z$ is based on a non-negative matrix decomposition.

17. The audio signal processing system of claim 15, wherein the parametric spectrogram data structure $\hat{V}_p^y$ includes parameters that model a time shift between the guide signal data structure g(t) and the audio mixture signal data structure x(t).

18. The audio signal processing system of claim 15, wherein the parametric spectrogram data structure $\hat{V}_p^y$ includes parameters that model an equalization difference between the guide signal data structure g(t) and the audio mixture signal data structure x(t).

19. The audio signal processing system of claim 15, wherein both estimating parameters of the parametric spectrogram data structure $\hat{V}_p^y$ and estimating parameters of the parametric spectrogram data structure $\hat{V}_p^z$, are performed according to minimization of a cost function (C).

* * * * *